US008905729B2

(12) United States Patent
Blankemeier et al.

(10) Patent No.: US 8,905,729 B2
(45) **Date of Patent: *Dec. 9, 2014**

(54) ROTODYNAMIC PUMP WITH ELECTRO-MAGNET COUPLING INSIDE THE IMPELLER

(75) Inventors: William R. Blankemeier, Oak Park, IL (US); Radosav Trninich, Bridgeview, IL (US)

(73) Assignee: PeopleFlo Manufacturing, Inc., Franklin Park, IL (US)

( * ) Notice: Subject to any disclaimer, the term of this patent is extended or adjusted under 35 U.S.C. 154(b) by 404 days.

This patent is subject to a terminal disclaimer.

(21) Appl. No.: 13/340,791

(22) Filed: Dec. 30, 2011

(65) Prior Publication Data

US 2013/0171012 A1 Jul. 4, 2013

(51) Int. Cl.
*F04D 13/02* (2006.01)
*F04D 29/041* (2006.01)

(52) U.S. Cl.
USPC ..... 417/420; 417/423.12; 417/423.14; 417/365; 277/630; 277/637; 277/641; 277/642; 277/643

(58) Field of Classification Search
CPC ..... F04D 13/24; F04D 13/25; F04D 13/26
USPC ..... 417/410.1, 420, 423.12, 423.14, 365; 277/628, 630, 637, 641, 642, 643; 310/103
See application file for complete search history.

(56) References Cited

U.S. PATENT DOCUMENTS 4,184,090 A 1/1980 Taiani et al.
4,645,433 A 2/1987 Hauenstein
4,648,808 A 3/1987 Hauenstein
4,793,777 A 12/1988 Hauenstein
4,836,147 A 6/1989 Morris
5,324,177 A * 6/1994 Golding et al. ..... 417/423.1
5,370,509 A 12/1994 Golding et al.
5,407,331 A * 4/1995 Atsumi ..... 417/420
5,501,582 A 3/1996 Gautier et al.
6,280,156 B1 8/2001 Wirz et al.
7,146,822 B2 12/2006 Stewart (Continued)

FOREIGN PATENT DOCUMENTS

JP 2009074434 A 4/2009
JP 2009254436 A 11/2009
WO WO 2008/000506 A1 1/2008

OTHER PUBLICATIONS

International Search Report for PCT/US2012/070923 dated Mar. 1, 2013.

(Continued)

*Primary Examiner* — Devon Kramer
*Assistant Examiner* — Nathan Zollinger
(74) *Attorney, Agent, or Firm* — Cook Alex Ltd.

(57) ABSTRACT

Rotodynamic pumps having an inner drive permanent magnet coupling disposed inside an impeller are provided. The impeller has a casing having a pumping region generally in a pumping plane that is perpendicular to the rotational axis of the impeller and aligned with a permanent magnet coupling that includes outer magnets that are connected to the impeller and at least partially aligned with the pumping region of the impeller, and inner magnets that are connected to an inner magnet ring and are axially aligned with the outer magnets. A canister is sealed to the casing and separates the outer magnets from the inner magnets.

20 Claims, 4 Drawing Sheets

(56) References Cited

U.S. PATENT DOCUMENTS

| | | | | |
|---|---|---|---|---|
| 7,707,720 | B2 | 5/2010 | Klein et al. | |
| 2003/0072656 | A1 | 4/2003 | Niwatsukino et al. | |
| 2003/0124007 | A1 | 7/2003 | Schima et al. | |
| 2003/0139643 | A1 * | 7/2003 | Smith et al. | 600/16 |
| 2004/0234395 | A1 | 11/2004 | Hatano | |
| 2004/0236420 | A1 * | 11/2004 | Yamane et al. | 623/3.14 |
| 2005/0012411 | A1 | 1/2005 | Hoffman et al. | |
| 2007/0280841 | A1 | 12/2007 | LaRose et al. | |
| 2010/0028176 | A1 | 2/2010 | Platt | |
| 2010/0280305 | A1 | 11/2010 | Hidaka et al. | |

OTHER PUBLICATIONS

Written Opinion of the International Searching Authority for PCT/US/2012/070923 dated Mar. 1, 2013.
International Search Report for PCT/US2012/070932 dated Mar. 13, 2013.
Written Opinion of the International Searching Authority for PCT/US2012/070932 dated Mar. 13, 2013.
International Search Report for PCT/US2012/070923 dated Mar. 13, 2013.
Written Opinion of the International Searching Authority for PCT/US/2012/070923 dated Mar. 13, 2013.

* cited by examiner

ROTODYNAMIC PUMP WITH ELECTRO-MAGNET COUPLING INSIDE THE IMPELLER

BACKGROUND OF THE INVENTION

1. Field of the Invention

The present invention generally relates to rotodynamic or centrifugal pumps, and more particularly to rotodynamic pumps having an electro-magnet coupling.

2. Discussion of the Prior Art

In many pumping applications, it is desirable to avoid rotating seals. Rotodynamic pumps have been developed with electro-magnet couplings that utilize an impeller that is driven via a non-contacting electro-magnet coupling in a radial magnet orientation. Such pumps frequently are referred to as being sealless, but actually include a stationary coupling component, and a rotating coupling component that are separated by a canister that is sealed with a static seal. Electro-magnet coupled rotodynamic pumps typically are of one of three types: close coupled; pump and motor separated by a thermal barrier; and vertical submerged.

Close coupled electro-magnet coupled rotodynamic pumps have an electro-magnet coupling that is mounted in a position that is behind the impeller. This may be referred to as a pump having an overhung impeller design. The overhung impeller design has the impeller mounted forward of and spaced from the electro-magnet coupling. The pump and the frame that supports the driving electro-magnet coupling generally are mounted on a common base plate. Rotodynamic pumps having the pump and motor separated by a thermal barrier generally are somewhat similar to close coupled electro-magnet coupled rotodynamic pumps but additionally have the electro-magnet coupling separated from the impeller by a thermal barrier air space. Vertical submerged electro-magnet coupled rotodynamic pumps generally also are of somewhat similar construction to the close coupled version, but the impeller is mounted on the lower end of a vertical shaft. The drive section utilizes an electro-magnet coupling to transmit power to the shaft and impeller.

Radial electro-magnet couplings are common in each of the above rotodynamic pumps, which may otherwise be referred to as kinetic or centrifugal pumps. The radial electro-magnet couplings consist of three main components: a stationary coupling component, such as a stator having multiple electro-magnets; a rotating coupling component, such as an armature with multiple magnets, either of the permanent or induced type; and a containment canister, such as a shroud or barrier separating the stationary and rotating components and forming a boundary of the pump's fluid chamber. The canister often is attached to the housing of the stationary component, such as an outer magnet or outer rotor, with multiple permanent magnets on its inner surface.

Radial electro-magnet couplings utilize a controller that energizes electro-magnets in the stationary component in a rotary sequence to create a rotating magnetic field. The magnetic field of the rotating component aligns and synchronizes with the rotating filed of the stationary component, such that the rotating component is forced to rotate with the rotating field of the stationary component, and drives the pump's impeller, such as a rotor. But neither of the inner or outer electro-magnet coupling components physically touches the other, and the rotating component rotates in a separate environment from the stationary component, separated by the canister.

The radial electro-magnetic couplings are of two configurations, "outer drive" and "inner drive". Most radial electro-magnet couplings in rotodynamic pumps have an outer drive arrangement in which the stationary component is larger than the rotating component and the stationary component is outside of the pump's fluid chamber. In such configurations, the inner rotating component is smaller than the stationary component and is disposed inside the pump's fluid chamber and is connected to the impeller. The containment canister provides the boundary of the pump's fluid chamber, with the fluid chamber being inside of the canister.

Although less common, some pumps have an inner drive arrangement, which utilizes the same three general components, but the roles are reversed. With an inner drive arrangement, the stationary component is smaller than the rotating component and is outside of the pump's fluid chamber. In turn, the rotating coupling component is larger than the stationary component and is disposed inside the pump's fluid chamber. The rotating component also is connected to the impeller. A containment canister again provides the boundary of the pump's fluid chamber, with the fluid chamber being outside of the canister. All of the inner drive electro-magnet rotodynamic pumps known to the inventors have a common configuration with respect to the location of the impeller relative to the electro-magnet coupling, with the impeller being positioned axially forward of the electro-magnetic coupling.

With the impeller being positioned forward of the electro-magnet coupling, such inner drive pumps have several disadvantages. The pumps are rather large, given that the axial space for the impeller is separate and forward of the axial space for the electro-magnet coupling. The relatively large pumps further require large and more expensive components, a large volume of space for mounting, and such pumps are heavier and more difficult to handle. The inner drive pumps also often experience an impeller thrust imbalance. The impeller is subjected to a high forward thrust load, due to the higher discharge pressure acting upon a relatively large rear surface of the impeller.

The prior art pumps also tend to have additional internal cavities where fluid can stagnate and which often must be flushed out between usages. In addition, the prior art pumps do not provide very effective cooling for the stator or canister, because the canister is not directly exposed to the incoming cool liquid that enters the pump through the inlet port. Canister cooling for such pumps is particularly important when the canister is made from electrically conductive materials, because such materials generate eddy current heating when the magnetic coupling is rotating.

Most of the existing inner drive electro-magnet coupled pump designs include an internal recirculation path, which allows a small amount of pumped fluid to flow from a higher pressure area (near the outlet port) to a lower pressure area (near the inlet port). Such a recirculation path serves three purposes: to prevent stagnation or solids accumulation within the pump; to improve cooling and/or lubrication of the impeller support bearings; and to improve cooling of the stator.

The details of existing recirculation paths vary widely among different pump designs and incorporate many different section designs. However, such internal recirculation paths tend to be rather complex, because they need to flow through an electro-magnet chamber located deep behind the impeller. The internal recirculation paths often include some sections where all the surfaces are stationary. The stationary sections more easily allow product stagnation and/or accumulation of solids.

The present disclosure addresses shortcomings in prior art pumping systems, while providing rotodynamic pumps having an electro-magnet coupling inside an impeller. The disclosure of inner drive pumps includes significant advantages over prior art pumps.

SUMMARY OF THE INVENTION

The purpose and advantages of the disclosed subject matter will be set forth in and apparent from the description and drawings that follow, as well as will be learned by practice of the claimed subject matter.

The present disclosure generally provides a rotodynamic pump with a radial, inner drive electro-magnet coupling disposed inside of an impeller. The rotodynamic pump has a casing defining a pumping cavity, an inlet port connected to the pumping cavity, and an outlet port connected to the pumping cavity. The pump has an impeller being rotatable about a rotational axis and disposed within the pumping cavity, the impeller having a pumping region generally in a pumping plane that is perpendicular to the rotational axis and aligned with an electro-magnet coupling that includes multiple outer magnets that are connected to the impeller and at least partially aligned with the pumping region of the impeller. The pump also includes a stationary component having multiple electro-magnets that are disposed inside of and are in axial alignment with the outer magnets. The pump further includes a canister that is sealed to the casing and separates the outer magnets from the multiple electro-magnets.

Thus, all or part of the electro-magnet coupling inside the impeller is disposed within the pumping plane and is axially aligned with the pumping region of the impeller. As such, the impeller has a large central opening for the electro-magnet coupling and the outer magnets are disposed within the central opening and connected to the impeller.

The present disclosure further provides an electro-magnet coupling in a rotodynamic pump that includes an internal circulation cooling flow path between the canister and the impeller. The internal circulation cooling flow path allows a small amount of pumped fluid to flow from a higher pressure area near the outlet port to a lower pressure area near the inlet port. The details of the path sections can vary, but the disclosure includes preferred sections. The first section is a chamber behind the impeller that is disposed between the impeller and a canister flange. The second section includes grooves in surfaces of a rear bushing. The third section includes a gap between the outer magnets and the canister. Some embodiments include a fourth section having grooves in surfaces of a front bushing. Such cooling paths avoid stagnation and accumulation of solids, while also permitting ready and more complete flushing of the entire pump when utilized in applications that require pumps to be flushed between uses.

The present disclosure further includes examples of alternative embodiments of rotodynamic pumps that highlight the fact that the inventive subject matter can be applied to pumps of various designs. For instance, the pumps may be of a design with an impeller having a radial flow, mixed flow or axial flow. Also, the impellers may have no shroud, a partial shroud or a full shroud. The pumps may be of metallic construction, or at least partially of non-metallic construction, such as for pumps where the fluids only contact non-metallic surfaces. Indeed, pumps in accordance with the present disclosure may include interior surfaces that are constructed of specific materials and/or have particular surface finishes wherein the interior surfaces permit use of the pumps in hygienic applications where microbial growth must be prevented. The improved flushing of circulation cooling paths and use of such surface finishes provide advantages for use in hygienic applications.

The electro-magnet coupling also may include some variations, such as being of a short profile that fits entirely within the length of the pumping region of the impeller or being a bit longer and having a portion of the electro-magnet coupling within the length of the pumping region of the impeller. Applications having higher torque requirements may be addressed with use of such longer couplings where the electro-magnet coupling may be at least partially disposed within the pumping region of the impeller. In addition, the canister may be of a multi-part or single part construction.

Utilization of the subject matter in the present disclosure can lead to construction of pumps that are more compact, since the electro-magnet coupling is imbedded at least partially within the pumping region of the impeller. Specifically, the axial length of pumps can be reduced, which may have advantages resulting in an ability to use many smaller and/or less expensive components. In addition, while inner drive versions of electro-magnet coupling pumps are capable of providing more torque within the same volume of space as an outer drive version, the capability of achieving extremely compact versions of inner drive electro-magnet couplings within an impeller of a rotodynamic pump, in accordance with the present disclosure, compounds the space saving advantage of an inner drive version for a given torque. These advantages, in turn, can result in pumps that require a smaller volume or space for mounting, and that are of lighter weight and are easier to handle.

Another potential advantage is that pumps using the subject matter of the present disclosure have fewer internal cavities where fluid can stagnate. This is especially advantageous in applications where such stagnation causes problems, such as when batch cross-contamination must be minimized, or in hygienic applications, where microbial growth must be prevented, and in any applications where the pumps must be flushed out completely between usages.

A further advantage can be realized in that the designs can provide exceptionally effective cooling for the bushings, and for stator and the canister, through the end portion of the canister, which is directly exposed to the cool liquid entering the pump through the inlet port. Canister cooling can be particularly important when the canister is made from electrically conductive materials, because such materials generate eddy current heating when the magnetic field is rotating.

Other potential advantages include that the pumps have an internal circulation path that is very simple and effective, because there is no deep chamber behind the impeller through which the fluid must circulate. Also, the internal circulation path is completely dynamic, such that no sections of the path consist of totally stationary surfaces. Thus, it is advantageous that pumps avoid having stationary sections of circulation cooling paths that more easily allow product stagnation and/or accumulation of solids.

A further advantage is that the net thrust load on the impeller is easier to balance than with typical designs, because of the large opening in the center of the impeller. The large opening reduces the surface area of both the front and rear of the impeller. Given that the higher discharge pressure acts upon the rear surface area of the impeller and creates a forward thrust load, the reduced rear surface area in this design reduces the forward thrust load. Similarly, the pressure exerted in the inlet port by the fluid entering the pump acts on the reduced front surface area of the impeller, reducing the rearward load applied to the impeller. The net effect is a reduction in forward thrust, because the discharge pressure is higher than the inlet pressure. The net thrust load on typical impellers is forward, and the reduced forward load helps to balance the thrust load on the impeller. A more balanced impeller thrust load is advantageous for pump wear life and it may avoid the need for heavy-duty thrust bearings.

It is to be understood that both the foregoing general description and the following detailed description are exemplary and provided for purposes of explanation only, and are not restrictive of the subject matter claimed. Further features and objects of the present disclosure will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

It should be understood that the drawings are not to scale. While some mechanical details of a rotodynamic pump with an electro-magnet coupling inside the impeller, including details of fastening means and other plan and section views of the particular components, have not been included, such details are considered well within the comprehension of those of skill in the art in light of the present disclosure. It also should be understood that the present invention is not limited to the example embodiments illustrated.

DETAILED DESCRIPTION OF THE PREFERRED EMBODIMENTS

Referring generally to FIGS. 1-4, it will be appreciated that rotodynamic pumps with an electro-magnet coupling inside the impeller of the present disclosure generally may be embodied within numerous configurations of rotodynamic or centrifugal pumps. Indeed, while acknowledging that all of the example configurations that may include an electro-magnet inner drive need not be shown herein, it is contemplated that the electro-magnet inner drive systems may be incorporated into various rotodynamic pumps. To demonstrate this position, a few examples of pump configurations are shown herein.

Figure 1:
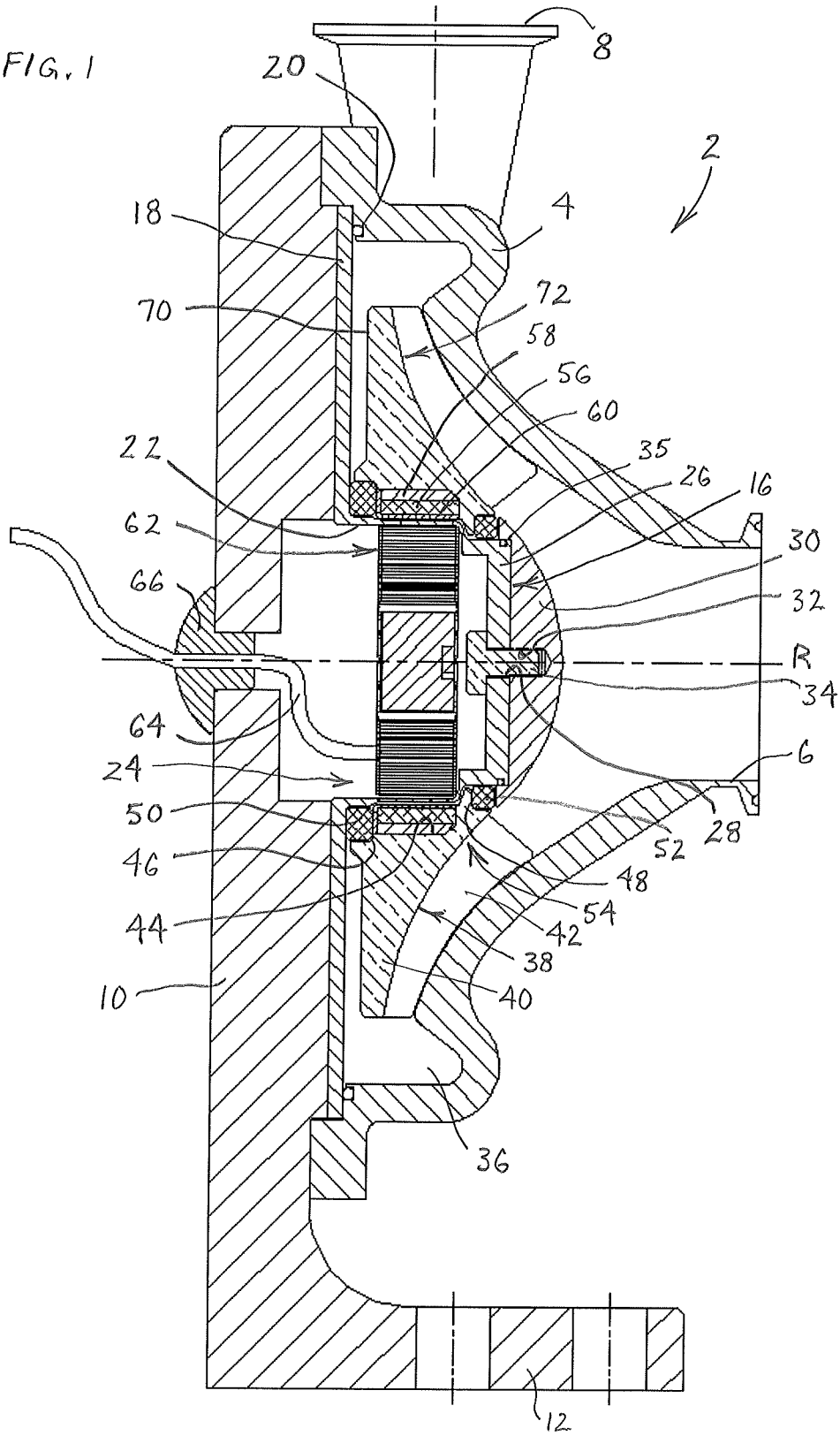
FIG. 1 is a cross-sectional view of a first example of a rotodynamic pump having a relatively short electro-magnet coupling within an impeller, with an inner drive having mixed flow, a partial shroud, metallic fluid contact surfaces, and a canister of multi-part construction.
Figure 2:
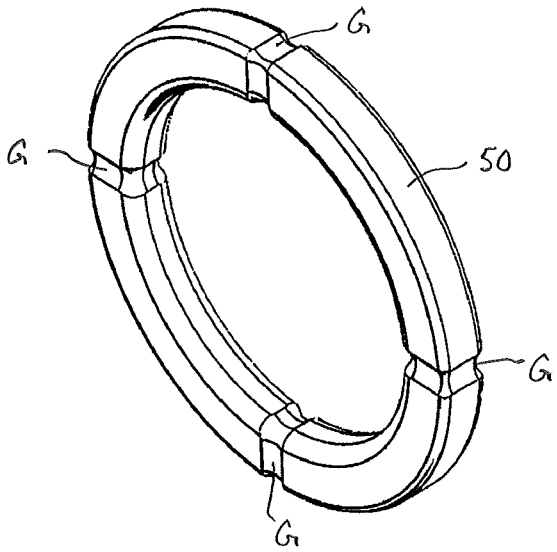
FIG. 2 is a perspective view of a thrust bearing shown in FIG. 1.

Turning to a first example embodiment in FIGS. 1 and 2, a rotodynamic pump 2 includes a casing 4 with an inlet port 6, and an outlet port 8. The casing 4 may be constructed of rigid materials, such as steel, stainless steel, cast iron or other metallic materials, or structural plastics or the like. However, it will be appreciated that the casing and all surfaces that contact the fluid that will flow through the pump may present a non-metallic surface, such as by use of a liner or application of a non-metallic coating.

The casing 4 is connected to an adapter 10, which includes a flange 12 for mounting to a base plate (not shown). Disposed in sealing engagement between the adapter 10 and the casing 4 is a canister 16 having a peripheral radial flange 18 that is sealed to the casing 4 by a first static seal 20. The static seal 20 may be constructed as an elastomeric o-ring, or preformed or liquid gasket materials or the like, which may be employed to enhance the connection between the components.

The canister 16 further includes a cylindrical portion 22 that has a rear opening 24, and a front end portion 26. The end portion 26 has a central aperture 28. The peripheral radial flange 18, cylindrical portion 22 and end portion 26 of the canister 16 may be constructed of any of a variety of rigid materials, and the material is typically chosen based on the medium to be pumped, but preferably is non-magnetic and constructed of stainless steel, such as alloy C-276, or of plastic, composite materials or the like. The canister 16 may be integrally fabricated from a single piece or may be fabricated, such as by welding together separately formed portions. A nose cone 30 has a threaded bore 32 that receives a fastener 34, such as a bolt, that passes through the aperture 28 in the end portion 26 of the canister 16 to connect the nose cone 30 to the canister 16. The nose cone 30 also is sealed to the canister 16 by a second static seal 35 that may be of similar construction to the first static seal 20.

The casing 4, the canister 16 and the nose cone 30 define an interior pumping cavity 36 that is in communication with the inlet port 6 and outlet port 8. An impeller 38 is disposed within the interior pumping cavity 36 and includes an impeller body 40 and vanes 42 extending therefrom, with a pumping region indicated by the axial length of the vanes 42. The impeller 38 has a partially shrouded construction and provides mixed axial and radial flow. It is desirable for the impeller 38 to have some form of thrust bearing surfaces. The impeller body 40 has a central opening 44 that includes a rear well 46 that together with an overlying magnet protection sleeve 60, discussed below, provides first axial and radial thrust bearing surfaces, and a front well 48 that provides second axial and radial thrust bearing surfaces. The first well 46 receives a rear bushing 50 and the second well 48 receives a front bushing 52. Alternative or additional provision for rearward and/or forward axial and radial thrust bearings also may be employed, and thrust bearings may be integrally or separately provided to retain appropriate positioning of components to reduce vibration and wear. In this example, the impeller 38 is rotatably coupled to the canister 16 via the bushings 50, 52, that engage the thrust bearing surfaces provided by the rear and front wells 46, 48, and the impeller 38 rotates about a rotational axis R. Alternatives to the bushings 50, 52 may be utilized and the bushings could be initially fixed to or otherwise engage the canister 16 or the impeller 38 during assembly of the pump 2.

To drive the impeller 38 in this first example pump 2, an electro-magnet coupling 54 is disposed within the central opening 44. The electro-magnet coupling 54 includes multiple outer magnets 56 connected, for instance, to an outer magnet ring 58 that is constructed with permanent or induced magnets, and is disposed in the central opening 44 and connected to the impeller 38. The outer magnets 56 may be of any suitable configuration, but are protected from the pumped fluid by a thin magnet protection sleeve 60 that, in this example, provides protection in both the axial and radial directions. The outer magnets 56 are at least partially axially aligned with the pumping region of the impeller 38. Thus, an imaginary plane that is perpendicular to the rotational axis of the impeller 38, and that passes through the pumping region and at least a portion of the electro-magnet coupling 54, may for convenience be referred to as a pumping plane.

The electro-magnet coupling 54 further includes inner electro-magnets 62, such as in the configuration of a stationary stator, with electrical power supplied by a power cable 64 that runs through a grommet 66 to a controller (not shown). The electro-magnets 62 are in close proximity to, axially aligned with, but separated from the outer magnets 56 by the relatively thin-walled cylindrical portion 22 of the canister 16. When energized via a controller, the electro-magnets 62 are energized in a rotary sequence to create a rotating magnetic field. The magnetic field provided by the outer magnets 56 of the rotating component matches up and synchronizes with the rotating magnetic field of the stationary electro-magnets 62 in the stator, and rotatably drives the impeller 38 that is connected to the outer magnets 56.

As best seen in FIG. 1, the impeller 38 has a rear surface 70 that is exposed to the discharged fluid that is under pressure. The forward thrust load generated by the discharge pressure on the rear surface 70 is at least partially balanced by the pressure of the fluid entering the inlet port 6 and engaging the front surface 72 of the impeller 38. The forward and rearward thrust loads on the impeller 38 may be balanced to a preselected degree. In turn, fluid under the higher discharge pressure is used in a circulation path to cool the canister 16, the bushings 50, 52, the outer magnets 56 and electro-magnets 62.

The circulation path in this example includes four sections, the first being a chamber behind the rear surface 70 of the impeller 38 through which fluid flows under pressure. The fluid flows from the first section to the second, which is formed by the rear bushing 50 having grooves G. The fluid further flows through the third section of the circulation path which includes the gap between the cylindrical portion 22 of the canister 16 and the protection sleeve 60 over the outer magnets 56. The fluid then flows through the fourth section, which is formed by the front bushing 52 having grooves G that are similar to those of the rear bushing 50. The fluid then flows out from around the nose cone 30 and rejoins the fluid entering the pumping cavity 36 through the inlet port 6. The rear bushing 50 is shown in a perspective view in FIG. 2, and in this example, the front bushing 52 is similarly configured but smaller than the rear bushing 50. The rear bushing 50 and front bushing 52 include grooves G that allow the fluid to pass the bushing in the circulation path. Further cooling is promoted by the fluid entering the inlet port 6 and engaging the nose cone 30 that is connected to the end portion 26 of the canister 16.

The electro-magnetic coupling 54 and location of the outer magnets 56 and inner electro-magnets 62 within the impeller 38 allows for a shorter length, more space efficient and lighter weight, drive and pump installation. This is further enhanced by the relatively short magnet coupling 54 that is within the pumping region of the impeller 38, generally in a pumping plane that is perpendicular to the rotational axis R of the impeller 38.

Figure 3:
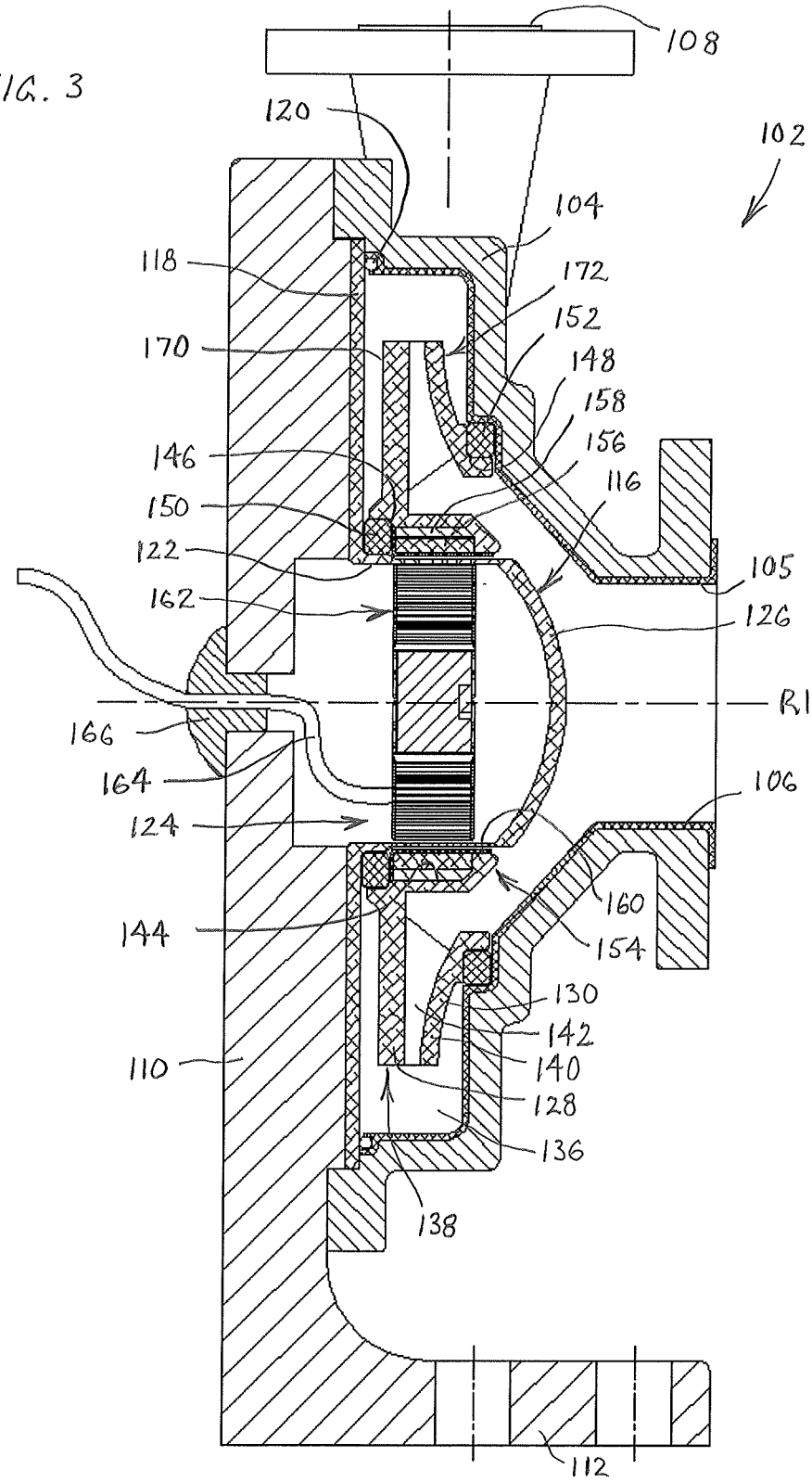
FIG. 3 is a cross-sectional view of a second example of a rotodynamic pump having a relatively short electro-magnet coupling within an impeller, with an inner drive having radial flow, a full shroud, non-metallic fluid contact surfaces, and a canister of single part construction.

Turning to a second example embodiment in FIG. 3, a rotodynamic pump 102 includes a casing 104 with an inlet port 106, and an outlet port 108. The casing 104 may be constructed of rigid materials, such as were described for the first example. In this example, the casing 104 also includes a non-metallic liner 105 to provide non-metallic surfaces that contact the fluid that will flow through the pump. This may present interior surfaces having surface finishes that are acceptable for particular applications.

The casing 104 is connected to an adapter 110, which includes a flange 112 for mounting to a base plate (not shown). Disposed in sealing engagement between the adapter 110 and the casing 104 is a canister 116 having a peripheral radial flange 118 that is sealed to the casing 104 by a first static seal 120. The static seal 120 may be constructed in a similar manner to that described above with respect to the first example embodiment. The canister of any of the examples also may be constructed with surface finishes in the interior of the pump that are acceptable for use in hygienic applications, such as by use of non-metallic or highly polished suitable metallic finishes.

The canister 116 further includes a cylindrical portion 122 that has a rear opening 124, and a front end portion 126. The end portion 126 presents a convex surface to the fluid that enters through the inlet port 106 to avoid turbulence. The end portion 126 effectively presents a nose cone that is a part of the sealed structure of the canister 116. The peripheral radial flange 118, cylindrical portion 122 and end portion 126 of the canister 116 are configured as a single piece and may be constructed of any of a variety of rigid materials, and in any suitable manner, such as described above with respect to the first example embodiment.

The casing 104 and the canister 116 define an interior pumping cavity 136 that is in communication with the inlet port 106 and outlet port 108. An impeller 138 is disposed within the interior pumping cavity 136 and includes an impeller body 140 and vanes 142 extending therefrom. The impeller 138 is constructed with a rear shroud 128 and a front shroud 130 and provides radial flow. It is desirable for the impeller 138 of this example to have some form of thrust bearing surfaces. The impeller body 140 has a central opening 144 that includes a rear well 146 that together with an overlying magnet protection sleeve 160, discussed below, provides first axial and radial thrust bearing surfaces, and a front well 148 that provides second axial and radial thrust bearing surfaces. The first well 146 receives a rear bushing 150 and the second well 148 receives a front bushing 152. Alternative or additional provision for rearward and/or forward axial and radial thrust bearings also may be employed, and thrust bearings may be integrally or separately provided to retain appropriate positioning of components to reduce vibration and wear. In this second example, the impeller 138 is rotatably coupled to the canister 116 via the bushings 150, 152, that engage the thrust bearing surfaces provided by the rear and front wells 146, 148, and the impeller 138 rotates about a rotational axis R1. As noted above, alternative bushing configurations may be utilized and the bushings could be initially fixed to or otherwise engage the canister 116 or the impeller 138 during assembly of pump 102.

To drive the impeller 138 in this second example pump 102, an electro-magnet coupling 154 is disposed within the central opening 144. The electro-magnet coupling 154 includes multiple outer magnets 156 connected, for instance, in an outer magnet ring 158 that is constructed with permanent or induced magnets, and is disposed in the central opening 144 and connected to the impeller 138. The outer magnets 156 may be of any suitable configuration, but are protected from the pumped fluid by a thin magnet protection sleeve 160 that, similarly to the first example, provides protection in both the axial and radial directions. The outer magnets 156 are at least partially axially aligned with the pumping region of the impeller 138.

The electro-magnet coupling 154 further includes inner electro-magnets 162, such as in the configuration of a stationary stator, with electrical power supplied by a power cable 164 that runs through a grommet 166 to a controller (not shown). The electro-magnets 162 are in close proximity to, axially aligned with, but separated from the outer magnets 156 by the relatively thin-walled cylindrical portion 122 of the canister 116. When energized via a controller, the electro-magnets 162 are energized in a rotary sequence to create a rotating magnetic field. The magnetic field provided by the outer magnets 156 of the rotating component matches up and synchronizes with the rotating magnetic field of the stationary electro-magnets 162 in the stator, and rotatably drives the impeller 138 that is connected to the outer magnets 156.

As seen in FIG. 3, the impeller 138 has a rear surface 170 that is exposed to the discharged fluid that is under pressure. The forward thrust load generated by the discharge pressure on the rear surface 170 is at least partially balanced by the pressure of the fluid entering the inlet port 106 and engaging the front surface 172 of the impeller 138. As with the first example, the forward and rearward thrust loads on the impeller 138 may be balanced to a preselected degree. In turn, fluid under the higher discharge pressure is used in a circulation path to cool the canister 116, bushings 150, 152, outer magnets 156 and electro-magnets 162. The circulation path for this example includes three sections, the first being a chamber behind the rear surface 170 of the impeller 138 through which fluid flows under pressure. The fluid flows from the first section to the second, which is formed by the rear bushing 150 having grooves, such as are shown in FIG. 2 in the rear bushing 50 of the first example embodiment. The fluid further flows through the third section of the circulation path which includes the gap between the cylindrical portion 122 of the canister 116 and the protection sleeve 160 over the outer magnets 156. The fluid flow then rejoins the fluid entering the pumping cavity 136 through the inlet port 106. Thus, the rear and front bushings 150, 152 are of a similar configuration to the rear bushing of the first example, shown in a perspective view in FIG. 2. Still further cooling is promoted by the fluid entering the inlet port 106 and engaging the front end portion 126 of the canister 116.

As with the first example pump 2, in this second example 102, the electro-magnetic coupling 154 and location of the outer magnets 156 and inner electro-magnets 162 within the impeller 138 allows for a shorter length, more space efficient and lighter weight, drive and pump installation. This is further enhanced by the relatively short magnet coupling 154 that is within the pumping region of the impeller 138, generally in a pumping plane that is perpendicular to the rotational axis R1 of the impeller 138.

Figure 4:
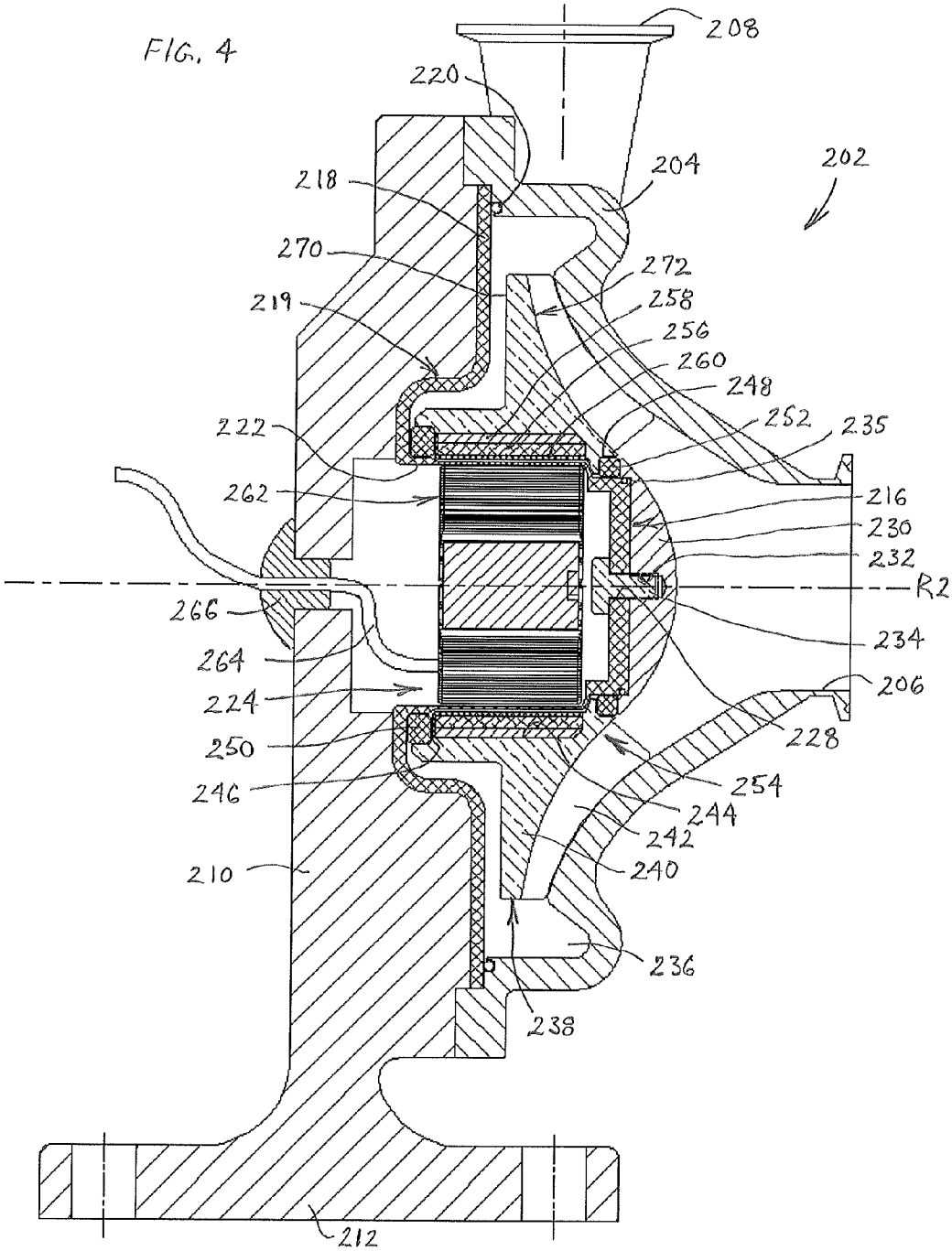
FIG. 4 is a cross-sectional view of a third example of a rotodynamic pump having a relatively long electro-magnet coupling within an impeller, with an inner drive having mixed flow, a partial shroud, metallic fluid contact surfaces, and a canister of multi-part construction.

Turning to a third example embodiment in FIG. 4, a rotodynamic pump 202 includes a casing 204 with an inlet port 206, and an outlet port 208. The casing 204 may be constructed of rigid materials, such as were described for the first example, and the casing 204 may include a non-metallic liner or coating to provide non-metallic surfaces that contact the fluid that will flow through the pump, as shown within the second example.

The casing 204 is connected to an adapter 210, which includes a lower flange 212 that facilitates mounting the pump 202 to a base plate (not shown). Disposed in sealing engagement between the adapter 210 and the casing 204 is a canister 216 having a peripheral radial flange 218 that extends from a rear inverted cup portion 219 and is sealed to the casing 204 by a first static seal 220. The static seal 220 may be constructed in a similar manner to that described above with respect to the prior example embodiments. As previously noted, the canister of any of the examples may be constructed with surface finishes in the interior of the pump that are acceptable for use in hygienic applications, such as by use of non-metallic or highly polished suitable metallic finishes.

The canister 216 further includes a cylindrical portion 222 that has a rear opening 224, and a front end portion 226. The end portion 226 has a central aperture 228. The peripheral radial flange 218, inverted cup portion 219, cylindrical portion 222 and end portion 226 of the canister 216 may be constructed of any of a variety of rigid materials, and in any suitable manner, such as described above with respect to the first example embodiment. The canister 216 also may be integrally fabricated from a single piece or may be fabricated, such as by welding together separately formed portions. Much like in the first example, in this pump 202, a nose cone 230 has a threaded bore 232 that receives a fastener 234, such as a bolt, that passes through the aperture 228 in the end portion 226 of the canister 216 to connect the nose cone 230 to the canister 216. The nose cone 230 also is sealed to the canister 216 by a second static seal 235 that may be of similar construction to the first static seal 220.

The casing 204, the canister 216 and the nose cone 230 define an interior pumping cavity 236 that is in communication with the inlet port 206 and outlet port 208. An impeller 238 is disposed within the interior pumping cavity 236 and includes an impeller body 240 and vanes 242 extending therefrom. The impeller 238 has a partially shrouded construction and provides mixed axial and radial flow. It is desirable for the impeller 238 to have some form of thrust bearing surfaces. The impeller body 240 has a central opening 244 that includes a rear well 246 that together with an overlying magnet protection sleeve 260, discussed below, provides first axial and radial thrust bearing surfaces, and a front well 248 that provides second axial and radial thrust bearing surfaces. The first well 246 receives a rear bushing 250 and the second well 248 receives a front bushing 252. As noted with the prior examples, alternative or additional provision for rearward and/or forward axial and radial thrust bearings also may be employed, and thrust bearings may be integrally or separately provided to retain appropriate positioning of components to reduce vibration and wear. In this third example, the impeller 238 is rotatably coupled to the canister 216 via the bushings 250, 252, that engage the thrust bearing surfaces provided by the rear and front wells 246, 248, and the impeller 238 rotates about a rotational axis R2. As noted above, alternative bushing configurations may be utilized and the bushings could be initially fixed to or otherwise engage the canister 216 or the impeller 238 during assembly of the pump 202.

To drive the impeller 238 in this third example pump 202, an electro-magnet coupling 254 is disposed within the central opening 244. The electro-magnet coupling 254 includes multiple outer magnets 256 connected, for instance, in an outer magnet ring 258 that is constructed with permanent or induced magnets, and is disposed in the central opening 244 and connected to the impeller 238. The outer magnets 256 may be of any suitable configuration, but are protected from the pumped fluid by a thin magnet protection sleeve 260 that, similarly to the prior examples, provides protection in both the axial and radial directions. The outer magnets 256 are at least partially axially aligned with the pumping region of the impeller 238.

The electro-magnet coupling 254 further includes inner electro-magnets 262, such as in the configuration of a stationary stator, with electrical power supplied by a power cable 264 that runs through a grommet 266 to a controller (not shown). The electro-magnets 262 are in close proximity to, axially aligned with, but separated from the outer magnets 256 by the relatively thin-walled cylindrical portion 222 of the canister 216. When energized via a controller, the electro-magnets 262 are energized in a rotary sequence to create a rotating magnetic field. The magnetic field provided by the outer magnets 256 of the rotating component matches up and synchronizes with the rotating magnetic field of the stationary electro-magnets 262 in the stator, and rotatably drives the impeller 238 that is connected to the outer magnets 256.

As seen in FIG. 4, the impeller 238 has a rear surface 270 that is exposed to the discharged fluid that is under pressure. The forward thrust load generated by the discharge pressure on the rear surface 270 is at least partially balanced by the pressure of the fluid entering the inlet port 206 and engaging the front surface 272 of the impeller 238. In turn, the fluid under the higher discharge pressure is used in a circulation path to cool the canister 216, bushings 250, 252, and magnets 256, 262. The circulation path includes four sections, the first being a chamber behind the rear surface 270 of the impeller 238 through which fluid flows under pressure. The fluid flows from the first section to the second, which is formed by the rear bushing 250 having grooves, such as are shown in FIG. 2 in the rear bushing 50 of the first example embodiment. The fluid further flows through the third section of the circulation path which includes the gap between the cylindrical portion 222 of the canister 216 and the protection sleeve 260 over the outer magnets 256. The fluid then flows through the fourth section, which is formed by the front bushing 252 having grooves, again such as those shown with respect to the aforementioned rear bushing 50 of the first example. The fluid then flows out from around the nose cone 230 and rejoins the fluid entering the pumping cavity 236 through the inlet port 206. Thus, the rear and front bushings 250, 252 are of a similar configuration to the rear bushing of the first example, shown in a perspective view in FIG. 2. Still further cooling is promoted by the fluid entering the inlet port 206 and engaging the nose cone 230 that is connected to the front end portion 226 of the canister 216.

Unlike the first and second example pumps 2, 102, in this third example pump 202, the inverted cup portion 219 still allows for a shorter length, more space efficient and lighter weight, drive and pump installation. This greater space efficiency is achieved, in part, by allowing for a longer magnet coupling 254 that may be provided for higher torque applications, while still locating at least a portion of the magnet coupling 254, the outer magnets 256, and the electro-magnets 262 within the pumping region of the impeller 238, generally in a pumping plane that is perpendicular to the rotational axis R2 of the impeller 238.

From the above disclosure, it will be apparent that pumps constructed in accordance with this disclosure may include a number of structural aspects that cause them to provide a magnet coupling inside an impeller that is disposed within a pumping plane, such that the electro-magnet coupling is at least partially axially aligned with the pumping region of the impeller. The pumps may exhibit one or more of the above-referenced potential advantages, depending upon the specific design choices made in constructing the pump.

It will be appreciated that a rotodynamic pump with electro-magnet coupling inside the impeller in accordance with the present disclosure may be provided in various configurations. Any variety of suitable materials of construction, configurations, shapes and sizes for the components and methods of connecting the components may be utilized to meet the particular needs and requirements of an end user. It will be apparent to those skilled in the art that various modifications can be made in the design and construction of such pumps without departing from the scope or spirit of the claimed subject matter, and that the claims are not limited to the preferred embodiments illustrated herein. It also will be appreciated that the example embodiments are shown in simplified form, so as to focus on the pumping principles and to avoid including structures that are not necessary to the disclosure and that would over complicate the drawings.

What is claimed is:

1. A rotodynamic pump having an inner drive electro-magnet coupling disposed inside an impeller comprising: a pump casing defining a pumping cavity;

an inlet port connected to the pumping cavity;

an outlet port connected to the pumping cavity;

an impeller being rotatable about a rotational axis and disposed within the pumping cavity and having vanes;

the impeller having a pumping region generally defined by an axial length of the vanes;

an electro-magnet coupling that rotatably drives the impeller and that includes outer magnets that are connected to the impeller and a stationary component having multiple electro-magnets that are disposed inside of and are in alignment with the outer magnets;

the pumping region being at least partially aligned with the electro-magnet coupling such that an imaginary plane that is perpendicular to the rotational axis of the impeller is able to pass through the pumping region and at least a portion of the electro-magnet coupling;

a canister that is sealed to the casing and separates the outer magnets from the multiple electro-magnets; and a nose cone connected to a front end portion of the canister wherein the nose cone is sealed to the front portion of the canister by a static seal.

2. A rotodynamic pump having an inner drive electro-magnet coupling disposed inside an impeller in accordance with claim 1, wherein the canister is of multi-part or single part construction.

3. A rotodynamic pump having an inner drive electro-magnet coupling disposed inside an impeller in accordance with claim 1, wherein the forward and rearward thrust loads on the impeller are balanced to a preselected degree.

4. A rotodynamic pump having an inner drive electro-magnet coupling disposed inside an impeller in accordance with claim 1, wherein fluid flow from the inlet port is directed toward a center of a front surface of the impeller.

5. A rotodynamic pump having an inner drive electro-magnet coupling disposed inside an impeller in accordance with claim 1, wherein the pump includes a circulation path that allows pressurized discharge fluid to flow past the canister, toward the inlet port and into the pumping cavity.

6. A rotodynamic pump having an inner drive electro-magnet coupling disposed inside an impeller in accordance with claim 5, wherein the pump includes at least one thrust bushing having a configuration that allows fluid to pass by the thrust bushing.

7. A rotodynamic pump having an inner drive electro-magnet coupling disposed inside an impeller in accordance with claim 6, wherein the at least one thrust bushing includes grooves that allow fluid to pass by the thrust bushing.

8. A rotodynamic pump having an inner drive electro-magnet coupling disposed inside of an impeller in accordance with claim 1, wherein the inlet port directs fluid flow axially relative to the impeller and fluid is discharged radially from the impeller to the outlet port.

9. A rotodynamic pump having an inner drive electro-magnet coupling disposed inside an impeller in accordance with claim 1, wherein the impeller includes a central opening that receives the outer magnets and a generally cylindrical portion of the canister.

10. A rotodynamic pump having an inner drive electro-magnet coupling disposed inside an impeller in accordance with claim 1, wherein all of the electro-magnet coupling is aligned with the pumping region of the impeller.

11. A rotodynamic pump having an inner drive electromagnet coupling disposed inside an impeller in accordance with claim 1, wherein the impeller provides axial, radial or mixed flow.

12. A rotodynamic pump having an inner drive electromagnet coupling disposed inside an impeller in accordance with claim 1, wherein the impeller includes no shroud, a partial shroud or a full shroud.

13. A rotodynamic pump having an inner drive electromagnet coupling disposed inside an impeller in accordance with claim 1, wherein interior surfaces of the pump that contact fluid flowing through the pump are metallic or nonmetallic.

14. A rotodynamic pump having an inner drive electromagnet coupling disposed inside an impeller in accordance with claim 1, wherein interior surfaces within the pump have a surface finish that is for hygienic applications.

15. A rotodynamic pump having an inner drive electromagnet coupling disposed inside an impeller in accordance with claim 1, wherein a protective sleeve is disposed between the outer magnets and the canister.

16. A rotodynamic pump having an inner drive electromagnet coupling disposed inside an impeller in accordance with claim 15, wherein the protective sleeve provides axial and radial protection of the outer magnets.

17. A rotodynamic pump having an inner drive electromagnet coupling disposed inside an impeller in accordance with claim 1, wherein the canister includes a peripheral flange.

18. A rotodynamic pump having an inner drive electromagnet coupling disposed inside an impeller in accordance with claim 17, wherein the peripheral flange of the canister is sealed to the pump casing by a static seal.

19. A rotodynamic pump having an inner drive electromagnet coupling disposed inside an impeller in accordance with claim 1, wherein the canister includes a cylindrical portion.

20. A rotodynamic pump having an inner drive electromagnet coupling disposed inside an impeller in accordance with claim 1, wherein the canister includes an inverted cup portion connected to a cylindrical portion.

* * * * *